United States Patent [19]

Mancosu et al.

[11] Patent Number: 4,823,785

[45] Date of Patent: Apr. 25, 1989

[54] DEVICE ASSOCIATED WITH A BREATHING MASK FOR ALLOWING THE INTRODUCTION OF LIQUID SUBSTANCES FOR THE USER, AND THE ASSOCIATED BREATHING MASK

[75] Inventors: Federico Mancosu, Milan; Giosue' Citelli, Abbiategrasso, both of Italy

[73] Assignee: Industrie Pirelli S.p.A., Italy

[21] Appl. No.: 936,943

[22] Filed: Dec. 1, 1986

Related U.S. Application Data

[63] Continuation of Ser. No. 701,017, Feb. 12, 1985, abandoned.

[30] Foreign Application Priority Data

Feb. 29, 1984 [IT] Italy ..... 19842 A/84

[51] Int. Cl.[4] ..... A62B 7/00

[52] U.S. Cl. ..... 128/202.15

[58] Field of Search ..... 607/77, 281, 282; 128/202.13, 202.15; 231/26–28, 33; 138/DIG. 8, DIG. 2, DIG. 42; 222/511, 512; 414/134–135

[56] References Cited

U.S. PATENT DOCUMENTS

| | | | |
|---|---|---|---|
| 1,903,831 | 4/1933 | Monro | 128/202.15 |
| 3,635,217 | 1/1972 | Potash | 128/202.13 |
| 3,645,261 | 2/1972 | West | 128/202.13 |
| 4,433,684 | 2/1984 | Sarnoff et al. | 128/202.15 |

FOREIGN PATENT DOCUMENTS

| | | | |
|---|---|---|---|
| 1274888 | 8/1968 | Fed. Rep. of Germany | 128/202.15 |
| 1273145 | 8/1961 | France | 128/202.15 |
| 2045094 | 10/1980 | United Kingdom | 128/202.15 |

*Primary Examiner*—Edward M. Coven
*Assistant Examiner*—K. M. Reichie
*Attorney, Agent, or Firm*—Stevens, Davis, Miller & Mosher

[57] ABSTRACT

A device associated with a gas mask suitable for introducing liquid substances to the user of the mask. The liquid substances are contained in a container provided with a penetrating or syringe-shaped nozzle. The device comprises a tubular conduit inside the mask having at least one elbow portion elastically deformable from a first idle position to a second position at or adjacent the user's mouth and vice versa, respectively, when the penetrating nozzle is introduced inside the conduit through the entire elbow portion and withdrawn from the same elbow portion.

10 Claims, 1 Drawing Sheet

DEVICE ASSOCIATED WITH A BREATHING MASK FOR ALLOWING THE INTRODUCTION OF LIQUID SUBSTANCES FOR THE USER, AND THE ASSOCIATED BREATHING MASK

DESCRIPTION OF THE INVENTION

This application is a continuation of application Ser. No. 701,017, filed Feb. 12, 1985, now abandoned.

The present invention is directed to a device associated with a gas mask and, more specifically, a device for introducing liquid substances to the user of the mask. More particularly, the invention is directed to a device for conveying liquid substances under pressure from a container to the mouth of the user provided with a mask of elastomeric material adapted to protect the face and the respiratory tract. The "liquid substances" are liquid nourishment or the like.

The field of application of the device is that of breathing masks worn by operators having the task of entering and monitoring regions contaminated by toxic substances, or by staff carrying out functions and operations in regions polluted in the consequence of military operations.

Devices of this type associated with breathing masks are already known. Generally, such devices are associated with breathing masks of elastomeric material and comprise mostly a tubular conduit disposed inside the mask connected to a tube disposed outside the mask for the introduction of liquid substances stored in a suitable container of rubber or other like deformable material. The conduit is provided at one of its ends with a wedge-shaped rigid element.

According to this arrangement, the tubular conduit disposed inside the mask is maintained at a first idle position through a suitable fulcrum lever connected to a rigid structure integral with the mask. The fulcrum lever comprises in turn two sides, one of which is subjected to the action of a return spring to press the conduit into the aforementioned idle position and the other through a suitable tooth, is subjected to the action of a rotating cam which is set in action by a suitable crank mechanism to overcome the action of the spring, and to change the conduit from the idle position to a position in proximity to the user's mouth.

An elastomeric tube disposed outside the mask defines an end part enclosed in a suitable liquid bag of the mask. The end part of the tube also includes a sealing valve, which acts in a tightly fitting manner under the influence of a biasing spring.

The actuation of the device for the introduction of liquid substances takes place by means of the following steps:

at first the operator withdraws the end part of the elastomeric tube disposed outside the mask from the suitable liquid bag;

then he introduces the wedge-shaped element into the elastomeric tube so as to overcome the opposition pressure of the spring on the value inserted in the same tube;

subsequently, the crank mechanism is set in motion to bring the cam into engagement with the tooth on the other side of the lever and to make the tubular conduit inside the mask rotate from the first idle position to a position very near the user's mouth, overcoming the action of the return spring; and finally, the operator, having placed the tubular conduit near the mouth, exerts a pressure on the deformable container, and inbibes the liquid substance.

Unfortunately, this solution is unsatisfactory.

In fact, both the lever system which moves the tubular conduit from the first to the effective position and the outer part, i.e., the tube with the sealing valve, constitute possible sources of irregular operation due to problems with calibration of the spring, possible defects in manufacturing, or small inaccuracies in assembling the mechanical parts.

In fact, a primary consideration is that the miniaturization of the mechanical parts—a miniaturization necessarily made due to the pre-arrangement of the parts in the small space usually available in the mask—requires assembly steps not always reproducible with accuracy.

In particular, one of the possible troublespots upon anomalous operation of the cited device is the operation between the operation cam and the lever tooth, which are the elements necessary for moving the tube from the idle position to the effective position.

A further drawback of the aforesaid arrangement resides in the fact that force required for the introduction of the wedge-shaped element into the tube in order to overcome the action of the opposing spring on the sealing value is often excessive and the wedge-shaped element could be deformed, preventing the user from imbibing the liquid substances.

Finally, the problems of carrying out a double operation for the double mechanical system provided, both for the introduction of the wedge-shaped element onto the outer tube and for the movement of the inner tubular conduit between the two positions, should be considered.

Therefore, the object of the present invention is to provide a device for introducing liquid substances under pressure between a container and a mask that will be devoid of any of the cited drawbacks.

The present invention is a device associated with a mask for introducing liquid substances to the user of the mask from a container provided with a syringe-shaped nozzle or like penetrating element, said device comprising at least a substantially tubular conduit arranged inside the mask which includes at least an elbow portion in the form of a curvilinear connector, said elbow portion being elastically deformable from a first idle position to a second position in proximity of the user's mouth and vice versa, respectively, when said penetrating part of the container is introduced inside said conduit over the entire elbow portion and removed from said elbow portion.

The present invention will be still better understood from the following detailed description, made by way of non-limiting example with reference to the figures of the accompanying drawings, in which:

FIG. 4 shows various details of FIG. 2, with the parts separated one from another.

FIG. 1 shows a breathing mask for protecting the face and the respiratory tract of a user.

Figure 1:
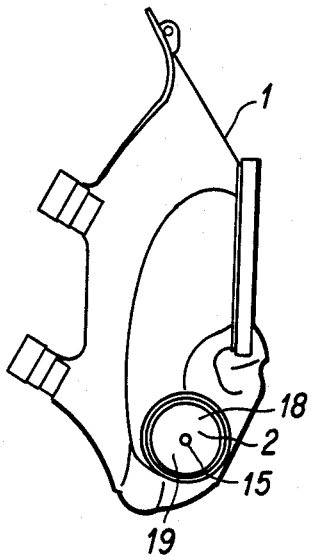
FIG. 1 is a lateral view of a breathing mask associated with a device for the introduction of liquid substances.

A device 2 is associated with the mask 1 for introducing liquid substances from a suitable container for example, of deformable material, for instance rubber, and provided with one end 3 having the shape of a syringe or like penetrating element.

The device 2 (FIG. 2) comprises mainly a tubular conduit 4 entirely arranged inside the mask, and a cylindrical-shaped rigid body 5 of plastic material associated with a wall of the mask of elastomeric material.

Figure 2:
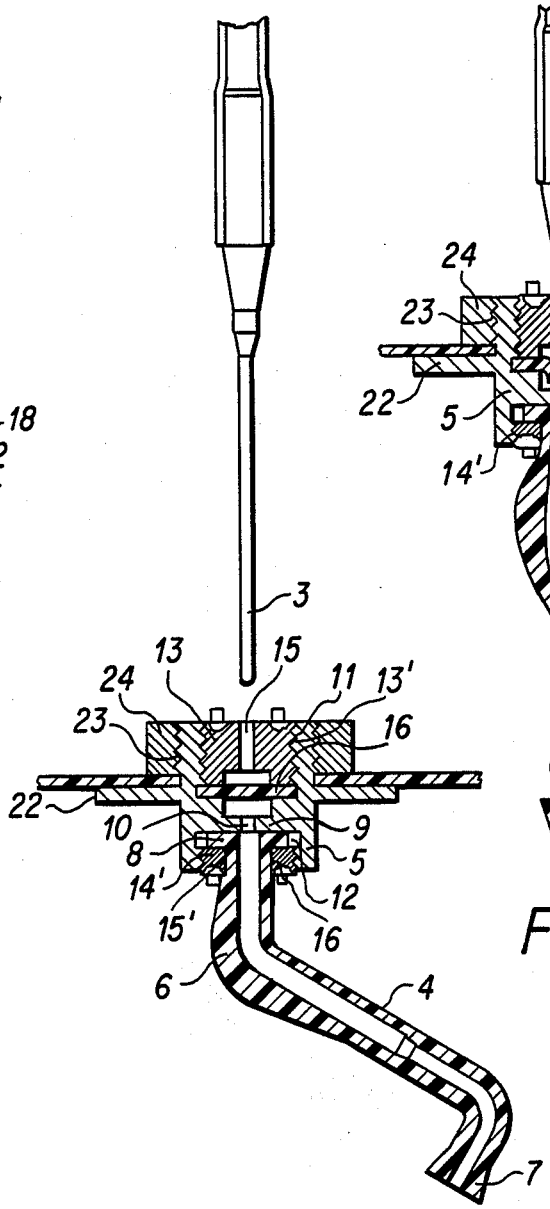
FIGS. 2 and 3 show, in longitudinal section, a preferred embodiment of the device associated with the mask of FIG. 1 before (FIG. 2) and after (FIG. 3) the insertion of the syringe-shaped nozzle.

The tubular conduit 4 of elastomeric material, as shown in detail in FIG. 2, includes at least an elbow portion substantially in the form of a curvilinear connector, with the angle between the two parts of the elbow connector being greater than 90°, for instance 120°.

As showmn in FIG. 2, the tubular conduit 4 comprises at the elbow portion 6 a marked thickness asymmetry; said asymmetry is designed to give a particular spring effect useful for the working of the device, as will be explained below.

Preferably, and considering a cross-section of the elbow zone 6 of the tubular conduit 4, the asymmetry extends for an arc less than 180°. The tubular conduit 4 comprises one flared end 7 adapted to be grasped by the mouth of the user and a further end 8 formed by a flange inserted in the cylindrical body 5.

Said rigid cylindrical body 5 is divided into two parts by a wall or a dividing partition 9 provided with a central hole 10. The wall 9 separates two cylindrical chambers 11 and 12, both threaded on their inner wall to receive two small cylinders 13 and 14. A cylinder 13 is provided with a central hole 15, having dimensions corresponding to the outer ones of a syringe-shaped nozzle 3 or like penetrating element, and the other cylinder 14 is provided with a central opening 15' corresponding to the outer dimensions of the conduit 4 in proximity of its flared end.

The cylinder 14 is screwed at threads 14' the corresponding chamber 12 clamp in a tight manner the flange 8 of the conduit 4.

The cylinder 13 is, in its turn, screwed via threads 13' the wall the cylindrical chamber 11 and clamps a sealing strip 16 of self-sealing elastomeric material.

Said cylinders 13 and 14 include means adapted to favor the removal of cylinders 13 and 14 from the corresponding chambers.

Preferably, said means take the form of two pins 18, 19 and 20, 21 (see FIG. 4) arranged in a diametrically opposed position on the front surfaces of the cylinders 13 and 14.

Figure 3:
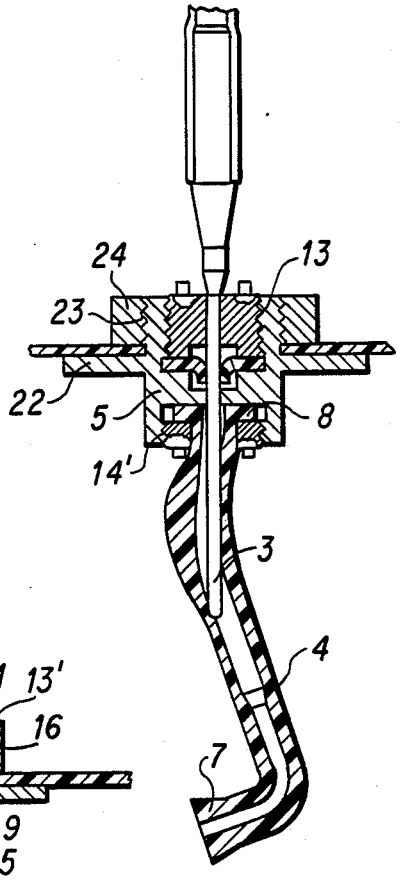

The device is associated with or attached to the mask with connecting means, indicated by way of example in FIGS. 2 and 3, with a flange 22 projecting from the lateral surface of the rigid body 5, having a thread 23 which is outside the rigid body, and a locking nut 24. Inserting and fastening the device on the mask is effected by introducing the device into a suitable hole provided on the facepiece of the mask and holding the mask wall tightly between the flange 22 and the nut 24.

The feeding is effected through the previously described device as follows:

the user introduces the syringe-shaped nozzle of the container through the inlet conduit 15 present on the cylinder 13 projecting from the surface of the mask, perforating in this way the sealing membrane of elastomeric material; and following the introduction of the syringe-shaped nozzle, the tubular conduit 4 which is inside the mask suffers a variation of its rest profile, nullifying the angle created by the elbow portion, moving it to the position of maximum extension (as shown in FIG. 3) in order to effect the seizing of the end 7 of the feeding conduit 4 by the mouth.

The introduction of the liquid substance or substances takes place when the user mechanically deforms the container and, consequently, forces the liquid substances to flow through the syringe-shaped nozzle.

In the step of removing the syringe-shaped nozzle 3, there occurs a cleaning of the syringe-shaped nozzle, since the liquid is retained by the sealing strip interposed in the rigid body;

a sealing (closing) of the tubular conduit since the sealing strip, being of a self-sealing elastomeric material, swells again owing to the presence of the retained liquid closing the hole originated by the passage of the syringe-shaped nozzle; and a spring-back of the tubular conduit 4 to the position shown in FIG. 2 through the return of the elastic energy accumulated therein by the deformation of the elbow portion 6.

The invention thus achieves the desired purposes. In fact, the introduction of liquid substances under pressure is made directly between the end part of the container, i.e., the syringe-shaped nozzle 3, and the tubular conduit 4 disposed inside the mask.

Therefore, in the present invention, a further tube or conduit arranged outside the mask acting as an intermediate element between the container and the conduit disposed inside the mask is not present.

Consequently, the user of the mask not only avoids one of the manual operations required in the previously known technique, but also avoids the possibility of any mechanical drawback deriving from the presence of a connection outside the mask; particularly those, as already said, caused by the need to seal with a closing valve comprising mainly a spherical or cylindrical rigid body and a biasing spring.

The present invention overcomes the known drawbacks and other drawbacks deriving from the known one since, as indicated above, the seal between ambient and the inner tubular conduit is effectuated by an elastomeric strip whose geometrical characteristic of being a thin disc-like membrane combined with its chemical-physical characteristics relating to a self-sealing composition, guarantees the cited sealing function in the absence of any mechanical drawback, both before the perforation of the sealing strip with the syringe-shaped nozzle 3, and on removal of the syringe-shaped nozzle 3 from the device.

It is also understood that it is possible, in case of need, to substitute one elastomeric sealing strip for another from a reserve of sealing strips by exerting only a screwing and unscrewing torque on the small cylinder 13 projecting from the mask outside.

Also, the present invention overcomes the drawbacks resulting from the previous state of the art due to the presence of complicated mechanical lever systems necessary to move the feeding tubular conduit disposed inside the mask between two distinct positions and, e.g., from the idle position to the effective position, and vice versa.

In fact, here the recourse to a tubular conduit 4 provided with an elbow connector of elastomeric material gives to the conduit itself an intrinsic characteristic of an opposing spring. Consequently, there is both an elastic opposition to any movement which tends to change the rest profile of the conduit 4 and the immediate return to the non-deformed position, as any spring would cause on stopping of the force that deforms the rest profile; in the specific case, following the removal of the syringe-shaped nozzle 3 from the mask.

Although particularly advantageous embodiments of the invention have been described, it is to be kept in mind that this inventiion also includes within its scope alternative embodiments readily accessible to technicians in the field and deriving from the inventive principles here explained. For instance, according to an alternative embodiment, the tubular conduit 4 disposed inside the mask could be made with an elastomeric material only in the elbow connector portion 6, and said portion 6 could then be associated through pipe wrench-actuated clamps, with possible further rigid tubular parts made from materials different from elastomeric materials, for instance a metallic or plastic material.

Moreover, the angle between the two convergent portions determining the elbow portion 6 may be different from that which has been shown and described.

The device, here described as associated with a mask for the protection of the face and the respiratory tract in civil or military regions polluted by unbreathable air or by gas or toxic substances, may also be associated with other means arranged on the face for different purposes, for instance medical purposes.

Also, the device of the present invention may be used with rigid helmets for the protection of the head, or also as a device associated with masks or the like arranged in shelters, in an emergency tent or in a life-raft used as an emergency shelter.

Further, the container could be different from a deformable container, i.e. it could have rigid walls combined with feeding means.

What is claimed is:

1. A device, adapted for use with a breathing mask having an aperture, for introducing liquid substances to a user of the mask from an external container having an end including a penetrating element, said device comprising a substantially tubular conduit having two ends; and a rigid body having a hole adapted to be connected to the aperture of said mask, said conduit being adapted to be disposed inside the mask, one of said ends of said conduit being connected to said hole of said rigid body so as to enable fluid communication between the exterior of the mask and said conduit via the aperture in the mask and said hole in said rigid body, and said conduit including at least one curvilinear elastomeric elbow means, said elbow means being elastically deformable from a first idle position at which the other one of said ends of said conduit is adapted to be remote from the user's mouth to a second position at which the other one of said ends of said conduit is adapted to be in proximity of the user's mouth responsive to the penetrating element of the container being introduced inside said conduit, via the aperture of the mask and the hole of said rigid body, through the entire elbow means and from said second position to said first position responsive to the penetrating element being removed from said elbow means.

2. A device as in claim 1, characterized in that said conduit is formed of an elastomeric material along its entire length.

3. A device, adapted for use with a breathing mask having an aperture, for introducing liquid substances to a user of the mask from an external container including a penetrating element attached to one end thereof, said device comprising a substantially tubular conduit having two ends to be (i) disposed inside the mask and (ii) secured at one end to the aperture in the mask, such that the penetrating element can be inserted through the aperture in the mask into said conduit, said conduit including at least one curvilinear elbow means, said elbow means being elastically deformable from a first idle position adapted to be remote from the user's mouth to a second position adapted to be in proximity of the user's mouth responsive to the penetrating element of the container being introduced inside said conduit, via the aperture of the mask, through the entire elbow means and from said second position to said first position responsive to the penetrating element being removed from said elbow means, said conduit comprising a greater wall thickness along the one side thereof adapted to be closest to the user's mouth in said first position for a predetermined arc in cross-section at said elbow means.

4. A device, adapted for use with a breathing mask having an aperture, for introducing liquid substances to a user of the mask from an external container including a penetrating element attached to one end thereof, said device comprising a substantially tubular conduit having two ends adapted to be (i) disposed inside the mask and (ii) secured at one end to the aperture in the mask, such that the penetrating element can be inserted through the aperture in the mask into said conduit to introduce the liquid substances from the container into said conduit, said conduit including at least one curvilinear elbow means, said elbow means being elastically deformable from a first idle position adapted to be remote from the user's mouth to a second position adapted to be in proximity of the user's mouth responsive to the penetrating element of the container being introduced inside said conduit, via the aperture of the mask, through the entire elbow means and from said second position to said first position responsive to the penetrating element being removed from said elbow means, said device fruther comprising an elastomeric membrane means supported between the aperture in the mask and said one end of said conduit, said membrane means (i) for enabling the penetrating element to pass through said membrane means and into said conduit and (ii) thereafter when the penetrating element is removed from said membrane means for self-sealing to tightly seal said one end of said conduit.

5. A device, adapted for use with a breathing mask having an aperture, for introducing liquid substances to a user of the mask from an external container including a penetrating element attached to one end thereof, said device comprising a substantially tubular conduit having two ends adapted to be (i) disposed inside the mask and (ii) secured at one end the aperture in the mask, such that the penetrating element can be inserted through the aperture in the mask into said conduit to introduce the liquid substances from the container into said conduit, said conduit including at least one curvilinear elbow means, said elbow means being elastically deformable from a first idle position adapted to be remote from the user's mouth to a second position adapted to be in proximity of the user's mouth responsive to the penetrating element of the container being introduced inside said conduit, via the aperture of the mask, through the entire elbow means and from said second position to said first position responsive to the penetrating element being removed from said elbow portion, said device further comprising a supporting body of rigid material adapted to be connected to the mask adjacent the aperture for supporting said one end of tho conduit to the mask, an elastomeric means supported to the mask between the aperture in the mask and said one end of said conduit, said elastomeric means (i) for enabling the penetrating element to pass through said elastomeric means and into said conduit and (ii) thereafter when the penetrating element is removed from said elastomeric means for self-sealing to tightly seal said one end of said conduit means, and two corresponding screwing cylinders, said one end of said conduit including an end flange, said supporting body of rigid material comprising a cylindrical member separated into two substantially hollow parts by an intermediate flange having a bore to enable fluid communication between said two parts, said flange being disposed inside said cylindrical member and extending substantially orthogonally relative to longitudinal surfaces of said cylindrical member, one of said two parts being adapted to be connected to the aperture in the mask to enable fluid communication from the aperture in the mask through said elastomeric means and said one of said two parts and into said bore and the other of said two parts, said two parts being threaded on their inside for receiving said two corresponding screwing cylinders, one of said two cylinders having a bore therethrough and clamping tightly said end flange of said tubular conduit against said intermediate flange, said conduit extending through said bore in said one of said two cylinders, and the second cylinder being perforated at its center and clamping tightly said elastomeric means against said intermediate flange.

6. A device as in claim 5, characterized in that each of said two cylinders includes unscrewing means on its end surface farthest from said intermediate flange.

7. A device as in claim 6, characterized in that said unscrewing means comprise pins outside each said end surface.

8. A mask of elastomeric material for protection of a user's face and respiratory tract and including an aperture, the mask comprising a device adjacent the aperture for introducing liquid substances from an outer container to a user of the mask, the container including a syringe-shaped nozzle attached to one end of the container, the mask being characterized in that said device comprises a tubular conduit having two ends (i) disposed entirely inside the mask and (ii) secured to the aperture in the mask, such that the penetrating element can be inserted through the aperture in the mask into said conduit to introduce the liquid substances from the container into said conduit, said conduit comprising at least one curvilinear elbow means elastically deformable from a first idle position adapted to be remote from the user's mouth to a second position adapted to be in proximity to the user's mouth responsive to said syringe-shaped nozzle being introduced inside said conduit through the entire elbow means and from said second position to said first position responsive to the penetrating element being removed from said elbow means.

9. A drinking system, adapted for use with a breathing mask having an aperture, for allowing introduction of liquid substances for a user of the mask, said system comprising (a) an external container for containing the liquid substances and including a penetrating element attached thereto and (b) a substantially tubular conduit having two ends adapted to be (i) disposed inside the mask and (ii) secured at one end to the aperture in the mask, such that the penetrating element can be inserted through the aperture in the mask into said conduit to introduce the liquid substances from the container into said conduit, said conduit including elastomeric elbow means for providing the conduit itself with an intrinsic spring characteristic opposing a variation in shape of said conduit from its rest profile, said conduit having a first idle position adapted to be remote from the user's mouth and corresponding to the rest profile of the elbow means and a second position corresponding to an elastic deformation of the elbow means toward a maximum extension of said conduit and adapted to be in proximity of the user's mouth, whereby responsive to introduction of the penetrating element through the conduit, via the aperture of the mask, said elbow means deforms to attain said maximum extension of said conduit and responsive to removal of the penetrating element from said conduit, said conduit springs back to said idle position as a result of return of elastic energy stored by said deformation of the elbow means.

10. A device as in claim 1, further comprising an elastomeric membrane means supported to the mask between the aperture in the mask and said one end of said conduit, said membrane means (i) for enabling the penetrating element to pass through said membrane means and into said conduit and (ii) thereafter when the penetrating element is removed from said membrane means for tightly sealing said one end of said conduit.

* * * * *